US008053044B2

(12) United States Patent
Zhou et al.

(10) Patent No.: US 8,053,044 B2
(45) **Date of Patent: *Nov. 8, 2011**

(54) MEDIA FOR INKJET WEB PRESS PRINTING

(75) Inventors: Xiaoqi Zhou, San Diego, CA (US); Kelly Ronk, San Diego, CA (US); Hai Quang Tran, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 850 days.

This patent is subject to a terminal disclaimer.

(21) Appl. No.: 11/831,540

(22) Filed: Jul. 31, 2007

(65) Prior Publication Data

US 2009/0035478 A1 Feb. 5, 2009

(51) Int. Cl.
*B41M 5/40* (2006.01)

(52) U.S. Cl. ..... 428/32.18; 428/32.2; 428/32.21; 428/32.27; 428/32.28; 428/32.29; 428/32.3; 428/32.34; 428/32.37

(58) Field of Classification Search ..... 428/32.18, 428/32.2, 32.21, 32.27, 32.28, 32.29, 32.3, 428/32.34, 32.37
See application file for complete search history.

(56) References Cited

U.S. PATENT DOCUMENTS

| | | | | |
|---|---|---|---|---|
| 4,442,172 | A | 4/1984 | Oshima et al. | |
| 4,554,181 | A * | 11/1985 | Cousin et al. | 428/32.3 |
| 5,223,338 | A * | 6/1993 | Malhotra | 428/32.29 |
| 5,302,437 | A | 4/1994 | Idei et al. | |
| 5,750,200 | A | 5/1998 | Ogawa et al. | |
| 5,952,091 | A | 9/1999 | Horand et al. | |
| 6,338,891 | B1 | 1/2002 | Kawasaki et al. | |
| 6,391,155 | B1 | 5/2002 | Wurster et al. | |
| 6,413,370 | B1 | 7/2002 | Wurster et al. | |
| 6,652,092 | B2 | 11/2003 | Sugiyama et al. | |
| 6,780,478 | B2 * | 8/2004 | Steiger et al. | 428/32.32 |
| 6,887,559 | B1 | 5/2005 | Darsillo et al. | |
| 6,991,330 | B2 * | 1/2006 | Maekawa | 347/105 |
| 7,144,475 | B2 | 12/2006 | Snover et al. | |
| 2001/0012556 | A1 * | 8/2001 | Kondo et al. | 428/195 |
| 2002/0012775 | A1 * | 1/2002 | Steiger et al. | 428/195 |
| 2005/0031805 | A1 | 2/2005 | Fugitt et al. | |
| 2005/0170108 | A1 | 8/2005 | Darsillo et al. | |
| 2006/0044383 | A1 | 3/2006 | Romano, Jr. | |
| 2006/0115634 | A1 * | 6/2006 | Park et al. | 428/195.1 |
| 2008/0008846 | A1 | 1/2008 | Zhou et al. | |
| 2009/0035478 | A1 * | 2/2009 | Zhou et al. | 427/466 |

FOREIGN PATENT DOCUMENTS

| | | |
|---|---|---|
| EP | 0943450 | 9/1999 |
| EP | 1122084 | 8/2001 |
| EP | 1658994 | 5/2006 |
| JP | 2006-247966 | 9/2006 |
| WO | WO 2006/052019 | 5/2006 |
| WO | WO 2008/005934 | 1/2008 |

OTHER PUBLICATIONS

The State Intellectual Property Office of The People's Republic of China, Notice on the First Office Action, Apr. 15, 2011, 3 pages.
Supplementary European Search Report for Application No. EP 08796885 dated Jun. 27, 2011 (3 pages).

* cited by examiner

*Primary Examiner* — Betelhem Shewareged

(57) ABSTRACT

A print media for inkjet web-press printing includes a paper base and a porous surface treatment. The porous surface treatment layer includes an inorganic pigment; at least one water-soluble and/or water-dispersible polymeric carrier; and at least one fixer. The fixer is a metal salt. A method of making print media is also disclosed.

24 Claims, 3 Drawing Sheets

MEDIA FOR INKJET WEB PRESS PRINTING

BACKGROUND

High speed inkjet web printing is a printing technology developed during recent years. Print media face huge challenges when used in high speed digital inkjet web printing. Poor image quality such as ink bleed coupled with poor black and color optical density are among the main problems encountered. Other problems include "image strike through" when double-sided printing is used. It is caused by ink over-penetration as well as poor media opacity. Not least among the problems is the extended dry time which is required with many conventional media and which limits the speed at which printing can be performed.

BRIEF DESCRIPTION OF THE DRAWINGS

Features and advantages of embodiments of the present disclosure will become apparent by reference to the following detailed description and drawings.

DETAILED DESCRIPTION

Figure 1:
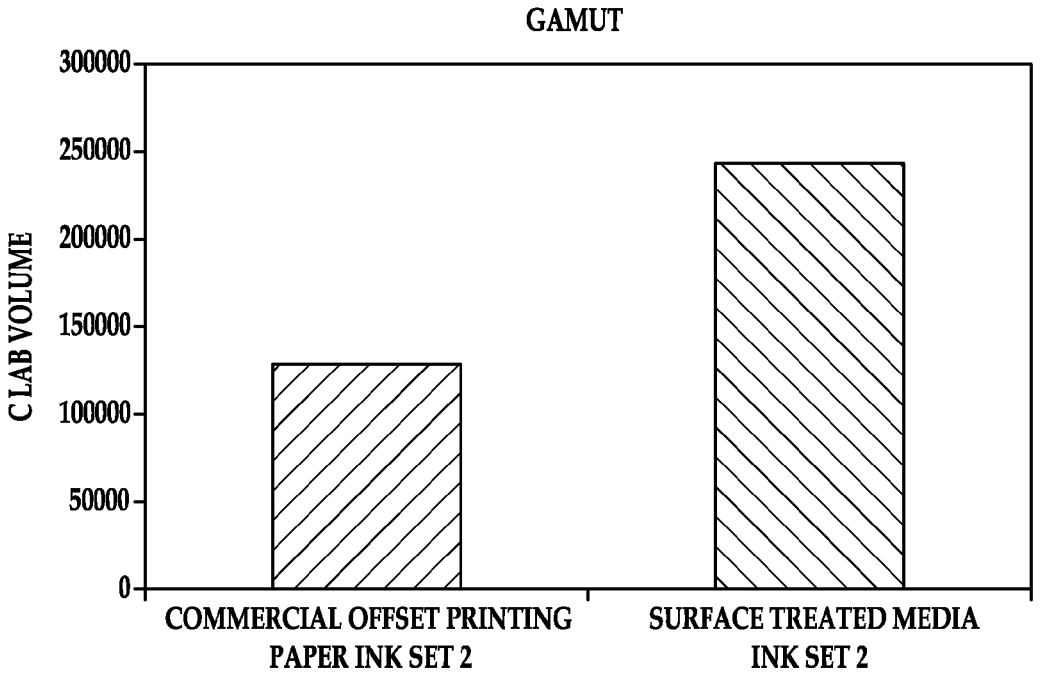
FIG. 1 shows a bar graph which compares color gamut for print samples printed with a given ink set on Surface Treated Media (prepared as described in Example 1) and Commercial Offset Printing Paper.

The present application relates to media that works particularly well with the inkjet digital web printing process. An important aspect of media according to embodiment(s) of the present disclosure is that the media shows fast ink absorption speed while readily fixing the colorants onto the media surface. These qualities are necessary to achieve good image quality under the conditions of the high speed digital web printing process. Without fast ink absorption speed, the printed image on the media needs extended dry time, which is not workable with the high speed digital inkjet web printing process. Poor ink absorption also creates image defects such as a high degree of ink bleed, edge roughness and line raggedness. However, excessive ink absorption into the bulk of base paper stock may tend to produce printed images which lack the black and color optical density that the consumer is expecting.

In order to address both of these existing issues, as well as others, of the high speed digital inkjet web printing process, the applicants in the present application have developed a media that includes a combination of fast ink absorption speed and ready fixation of colorants on the media surface to achieve good image quality as manifested in terms of color gamut and black and color optical density. In addition the media of the present application is developed to have increased opacity, which helps to overcome the problem of "image strikethrough" onto the opposite surface of the media. The media of the present application also achieves improved gloss and brightness.

The digital inkjet web printing media of the present application includes a cellulose paper base and a surface treatment composition which can be applied on a single side or both sides of the paper base. The base paper has a basis weight ranging from about 35 gsm to about 90 gsm. With from about 5% to about 35% by weight of filler, the base paper can be made of wood pulp (i.e., groundwood pulp, thermomechanical pulp, chemo-thermomechanical pulp, or combinations thereof), wood-free pulp, or combinations thereof. Furthermore, in some embodiments, there is from about 60% to about 90% by weight of recycled pulps used to make base paper stock.

The capability and speed of the base paper stock to absorb aqueous solvents is especially critical to this media. However, excessive absorption will bring the colorant into the bulk area of the base, resulting in low black and color optical density and low color gamut. This may create a "washed out" image. Poor absorption, on the other hand, creates a situation in which the ink bleeds and smears readily. Poor absorption also necessitates an increase in dry time, which in turn slows down web printing speed.

Aqueous solvent absorption in base paper stock is mainly controlled by applying sizing processes to the base paper stock including the processes of internal and surface sizing. However, it is generally desired that the absorption of aqueous solvents be obtained by internally sizing the substrate. This is when the sizing agents are added to the pulp suspension before it is converted to a paper web or substrate. Internal sizing helps prevent the surface sizing from soaking into the sheet, thus allowing the surface sizing to remain on the surface where it has maximum effectiveness. The internal sizing agents for use in the present application encompass any of those used at the wet end of a paper machine. These include rosin sizes, ketene dimers and multimers, and alkenylsuccinic anhydrides. The internal sizing agents are generally used at concentration levels known to those skilled in the art, for example, at levels from about 0.01 wt. % to about 0.5 wt. % based on the weight of the dry paper sheet. Degrees of sizing are designated by Hercules size values, which are measured on the Hercules sizing tester (HST) as described in TAPPI STANDARD T-530 pm-83. HST values will vary directly with the basis weight of the substrate and other factors such as weight percentage and surface area of filler, amount and type of internal sizing agent, and the reflectance end point as specified in TAPPI T 530. To achieve an optimum result in digital inkjet web printing media, the retention time of the base paper as measured with 80% reflectance by the Hercules sizing tester should be in the range of from 10 seconds to 95 seconds. In an alternate embodiment, the retention time should be from 20 seconds to 75 seconds.

Surface smoothness of base paper stock is another important quality in the media of the present application. The base paper stock's surface smoothness largely determines both the gloss and surface smoothness of the digital web printing media. This is especially the case when a very low amount of surface treatment composition is applied.

Surface smoothness of the base paper stock is determined with a Parker Print-Surf tester. Smoothness values conducive to digital inkjet web printing media are in the range from 0.8 to 6.0 microns.

The surface treatment composition is applied to at least one, and possibly both, sides of the base paper stock. The composition includes at least one inorganic pigment, at least one polymeric carrier and at least one colorant fixer. In an embodiment, the inorganic pigment has a platelets morphology (i.e. plate-like structures), which performs a positive "covering" function in relation to the base paper stock. The inorganic pigment covers the fibers in the surface of the base paper stock, thus smoothing out the media surface. The inorganic pigment further acts to increase the opacity, brightness, whiteness and glossiness of the media.

One of the primary purposes of inorganic pigment particles is to retain the ink at or near the outer surface of the image-receiving layer. A major part of this ink-retaining function is accomplished as a result of the platelet shape of inorganic pigment particles. The platelet shape of the pigment particles can be quantitatively described by their aspect ratio which is the ratio of the ESD (equivalent spherical diameter) of the particles to their average thickness. Specifically, the platelet shape acts to help control the degree and rate of liquid ink migration into the base paper stock. Such retention of the colorant of the ink at or near the outer surface of the image-receiving layer is very desirable to achieve appropriate black and color optical density and color gamut.

Examples of inorganic pigments that can be used in the present application include aluminum silicate, kaolin clay, calcium carbonate, silica, alumina, boehmite, mica, magnesium carbonate and talc. In an embodiment, the inorganic pigment used is aluminum silicate. In general, inorganic pigments used in the present application have an average particle size in the range of from about 0.5 to about 8 microns, measured in terms of ESD, and have an average ESD of about 0.9 microns to about 1.6 microns as determined by a Microtrac-UPA 150 laser light scattering device. Specifically, in an embodiment, not more than 5 percent by weight of the inorganic pigments in the present application have an ESD greater than 4.5 microns, nor do more than 10 percent by weight have an ESD smaller than 0.3 microns. The higher percentage of small ESD particles tends to reduce the "covering" effect. The aspect ratio of pigment particles, which is the ratio of the ESD of the particles to their average thickness, ranges from about 10 to about 50. In an alternate embodiment, it ranges from about 5 to about 30, and in a further alternate embodiment, it ranges from about 8 to about 25.

The pigment particles may be pre-dispersed into a filter-cake slurry with a solids content of about 40 to about 70 percent by weight before loading into the surface treatment composition. Optionally, other co-pigments can also be used in the surface treatment composition to improve ink absorbance. Such co-pigments include, for example, pigments that have both a micro-porous structure, such as fumed silica and silica gels, and "structured" pigments. The structured pigments are those particles which have been made in a special manner to create a micro-porous structure. Examples of these structured pigments are calcine clays and porous clays/calcium carbonate that are reaction products of clay/calcium carbonate with colloidal silica. Other inorganic particles such as particles of titanium dioxide ($TiO_2$), silicon dioxide ($SiO_2$), aluminum trihydroxide (ATH), calcium carbonate ($CaCO_3$) and zirconium oxide ($ZrO_2$) can be inter-calcined into the structured clay or calcium carbonates. For one embodiment, co-pigment particles may be substantially non-porous mineral particles that have a special morphology that can produce a porous coating structure when solidified into a coating layer. One example of such particles is aragonite precipitated calcium carbonate. These particles have a needle-like structure on a microscopic scale, i.e., they have a high aspect (length-to-width) ratio. This structure results in a loose coating layer packing with a relatively large fraction of voids on the coating surface.

Other types of co-pigments include organic polymeric pigments such as polystyrene and polyacrylates known as hollow plastic pigments. The term "hollow plastic pigment" refers to one or more void(s) within the outer dimension of the pigment volume. The hollow plastic pigments can have a diameter from about 0.3 to 10 μm, with a glass transition temperature (Tg) from about 50° C. to 120° C. The examples of such plastic co-pigments include, but are not limited to Ropaque® HP-543, Ropaque® HP-643, Ropaque® HP-1055, or Ropaque® OP-96 (available from Rohm and Haas Co. (Philadelphia, Pa.)) or Dow HS 2000NA, Dow 3000NA, Dow 3020NA, or Dow 3042NA (available from Dow Chemical Co. (Midland, Mich.)).

In addition to the inorganic pigments described above, the surface treatment composition contains one or more water-soluble and/or water-dispersible carriers. These carriers function as the binder to inorganic pigments and as the surface sizing agent to improve the surface properties of base paper stock. Examples of the carriers include water-dispersible and water-soluble polymeric compounds, such as polyvinyl alcohol, starch derivatives, gelatin, cellulose derivatives, acrylamide polymers, acrylic polymers or copolymers, vinyl acetate latex, polyesters, vinylidene chloride latex, styrene-butadiene, acrylonitrile-butadiene copolymers, styrene acrylic copolymers, and copolymers and/or combinations thereof. The starch derivatives used in the disclosure can be any species made from potato, corn, tapioca and the like, and by reacting with suitable chemicals or enzymatic reagents to form cationic starch, anionic starch, oxidized starch, starch esters, starch ethers, starch acetates, starch phosphates and/or a combination thereof.

The surface treatment composition comprises at least one colorant fixative that can chemically, physically, and/or electrostatically bind the colorant materials in the ink at or near the outer surface of the web press inkjet printing media of the present application. By this means, the printing image quality including optical density, color gamut, "image strike through" and the like is improved; and a high degree of water-fastness, smear-fastness, and overall image stability is achieved. Dry time is also reduced.

For purposes of web inkjet printing media with pigmented inks, water-soluble or water-dispersible metallic salts are used as the ink fixative. The metallic salts may include water-soluble mono- or multi-valent metallic salts. In an embodiment, the metallic salts include multi-valent metallic salts. The metallic salt may include cations, such as Group I metals, Group II metals, Group III metals, or transition metals, such as sodium, calcium, copper, nickel, magnesium, zinc, barium, iron, aluminum and chromium ions. An anion species can be chloride, iodide, bromide, nitrate, sulfate, sulfite, phosphate, chlorate, acetate ions, or various combinations.

The effective amount of water-soluble and/or water dispersible metallic salts used in the surface treatment composition is decided by the type of ink, amount of surface treatment composition applied to base paper stock, and type of base paper stock. In an embodiment of the present disclosure, the amount of water-soluble and/or water-dispersible metallic salts can be in a range of 1 kg per metric ton of dry base paper stock to 15 kg/T. In an embodiment, this ranges from about 2 kg/T to about 10 kg/T.

When dye inks are used, either alternatively or in addition to pigmented inks, optionally, the fixative, in addition to the metallic salts, can be a cationic polymer, e.g., a polymer having a primary or secondary or tertiary amino group and a quaternary ammonium salt group or a quaternary phosphonium salt group, such as poly(dimethyl diallyl ammonium chloride), polyamine, polyethylenimine and polybiguanadine.

Because most inorganic pigments have an anionic charge, to protect the pigments from being precipitated out during addition of cationic fixatives, a non-ionic water soluble polymer solution is pre-mixed with the pigment slurry after which the cationic fixative is added at the last step of mixing. The non-ionic water soluble polymer solution may be, for example, polyvinyl alcohol solution with a molecular weight of from 8500 to 12400 and which is 60-90% partially hydrolyzed. In one of the embodiments of the current disclosure, a high shear speed mixer such as an Ystral high shear mixer was used to break out any possible particle aggregation during mixing. The Ystral mixer ran with a 4/4 stator at 60 Hz using the chiller set at 100% output for 20 minutes.

The surface treatment composition can be applied on base paper stock by an on-line surface size press process such as a puddle-sized press or a film-sized press, or the like. The puddle-sized press may be configured as having horizontal, vertical, or inclined rollers. The film-sized press may include a metering system, such as gate-roll metering, blade metering, Meyer rod metering, or slot metering. For some embodiments, a film-sized press with short-dwell blade metering may be used as an application head to apply a coating solution. The coating weight of the surface treatment composition is directly related to ink absorption by the base paper stock, and is substantially precisely controlled in the range from about 2 gsm to about 10 gsm. In an embodiment, the coating weight is not more than 8 gsm. In addition to on-line surface sizing processing, the off-line coating technologies can also be used to apply the surface treatment composition to base paper stock. Examples of suitable coating techniques include, but are not limited to, slot die coaters, roller coaters, fountain curtain coaters, blade coaters, rod coaters, air knife coaters, gravure applications, air brush applications and other techniques and apparatuses known to those skilled in the art. A calendaring process may optionally be used after drying the composition to improve surface smoothness and gloss.

The media of the present application shows quick ink absorption but fixes the colorants on the media surface so that it fits the operational speed of high speed web ink printers without sacrificing the image quality. The media also shows improved physical properties like opacity, gloss and brightness.

EXAMPLES

Example 1

Preparation of a Surface Treatment Composition

Aluminum silicate particles were pre-dispersed into a filter-cake slurry. The co-pigments and, as necessary, a certain amount of water were added into the pigment slurry, followed by a polyvinyl alcohol solution and pre-dissolved metal salt such as calcium chloride solution. The polymeric carrier was then added slowly with strong stirring. If a cationic polymer was used in the formulation, it was usually added at the end with strong stirring. Optionally some functional additives, such as dispersants, optical brighteners, fluorescent dyes, surfactants, deforming agents, preservatives, pH control agents, and the like can be added into the composition. The mixing can be carried out in a regular low shear bench mixer agitating with 500-800 rpm. A high shear mixer such as the Ystral mixer was optionally used running with a 4/4 stator at 60 Hp using the chiller set at 100% output for 20 minutes.

Example 2

Comparison of Color Gamut and Black Optical Density Between Surface Treated Media and Commercial Offset Printing Media The surface-treated inkjet web press printing media, as made by the methods described in Example 1, was printed, along with a commercial offset printing media. The offset printing media had a pigmented coating and was calendared with the same basis weight as the tested web press media. Two different pigmented ink systems were used to prepare printed images including color printed images. The two printers used were the HP PhotoSmart Pro B9180 (using the standard ink cartridges, herein labeled as Ink Set 1) and the HP CM8060 Color MFP with Edgeline Technology (using the standard ink cartridges, herein labeled as Ink Set 2), both of which are manufactured by Hewlett-Packard Co. The color gamut of each printed image was recorded, and the results are provided as a bar graph in FIG. 1, with the y axis gauging increasing amounts of C L*a*b* volume, a measure of color gamut. The color gamut measurements were carried out on squares of primary color (cyan, magenta, and yellow) and secondary colors (red, green, and blue) plus white (un-imaged sheets) and black colors. L*a*b* values were obtained from the measurement and thereafter were used to calculate the 8-point color gamut, where the higher value of color gamut indicates that the prints show richer or more saturated colors. As shown in FIG. 1, the color gamut measurements for a printing of Ink Set 2 printed on Commercial Offset Printing Paper and Ink Set 2 printed on Surface Treated Media (prepared according to Example 1) were compared and Surface Treated Media is shown to register significantly higher in terms of color gamut.

Figure 2:
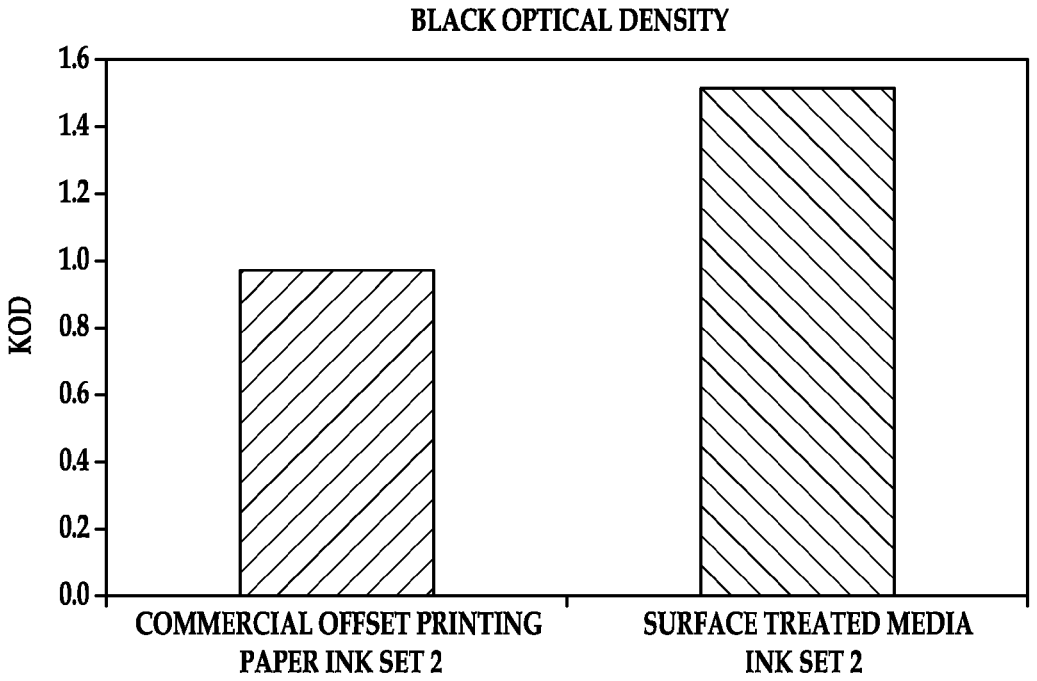
FIG. 2 shows a bar graph which compares black optical density for print samples printed with a given ink set on Surface Treated Media (prepared as described in Example 1) and Commercial Offset Printing Paper.

The black optical density (KOD) measurements were carried out on the same samples from above, using an X-Rite densitometer to measure the blackness of the area filled. The results are provided in FIG. 2, a bar graph, with the y axis gauging increasing amounts of KOD. The higher value, that of Ink Set 2 printed on Surface Treated Media (prepared according to Example 1), indicates a darker printing effect than Ink Set 2 printed on Commercial Offset Printing Paper.

Example 3

Comparison of Dry Time Between Surface Treated Media and Commercial Offset Printing Media In this test, samples of the surface treated inkjet web press printing media as made by the methods described in Example 1, as well as a commercial offset printing media were used to print a series of black squares using an HP PhotoSmart Pro B9180 (using the standard ink cartridges, herein labeled as ink set 1), which is manufactured by Hewlett-Packard Co. After waiting 10 seconds after printing, the samples were covered with the same type of paper and rolled with a 4.5 lb. rubber hand roller, model HR-100, manufactured by Chem-instruments, Inc. The samples were then allowed to air dry. The optical densities ($OD_t$) of the images transferred on the cover sheets as well as the optical density of the reference (original non-transferred, $OD_r$) were measured with an X-Rite densitometer to indicate the density before and after rolling. An unprinted area was also measured to obtain a value for the paper background, $OD_b$. The percent of ink transferred (% IT) for the various papers is then calculated using the following equation:

$$\%IT=1-(OD_r-(OD_t-OD_b))/OD_r\times 100\%$$

Figure 3:
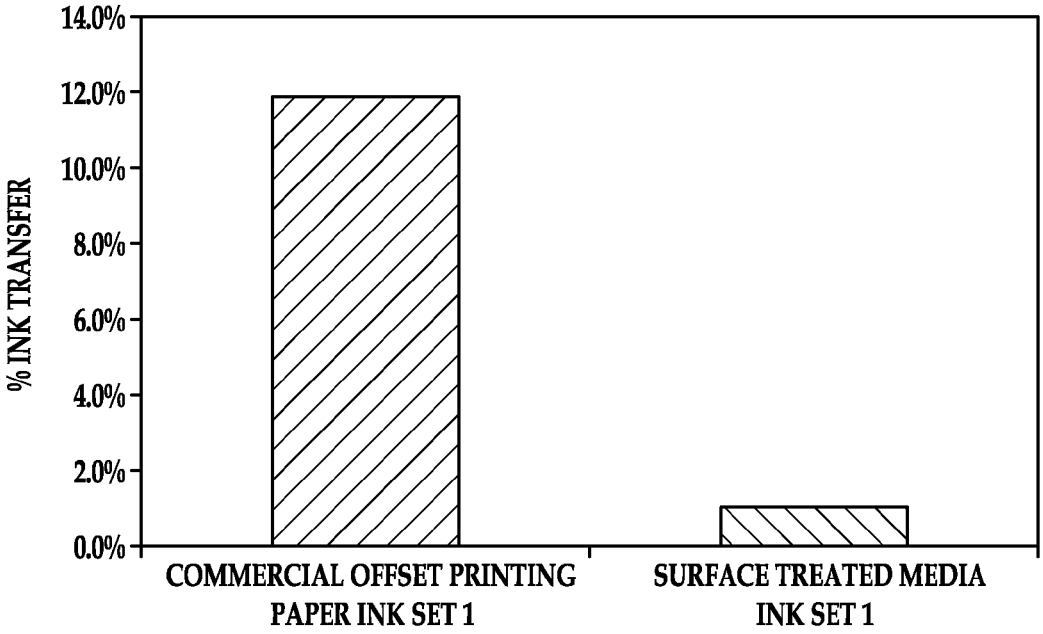
FIG. 3 shows a bar graph which compares dry time of ink for print samples printed with a given ink set on Surface Treated Media (prepared as described in Example 1) and Commercial Offset Printing Paper.

The higher the value of % IT, the more ink transferred, which is an indication of poor ink dry time and poor fixing of ink to media. The results are provided in FIG. 3, which is a bar graph, the y axis gauging % ink transfer. The graph indicates a marked difference between the % ink transfer of Ink Set 1 printed on Surface Treated Media (prepared according to Example 1) with Ink Set 1 printed on Commercial Offset Printing Paper.

Example 4

Figure 4:
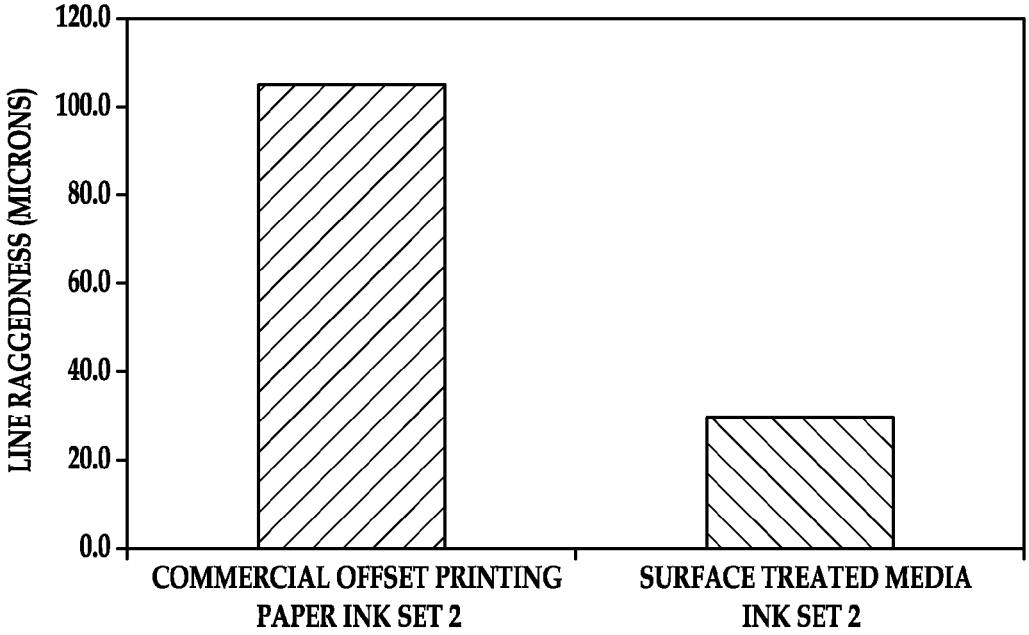
FIG. 4 shows a bar graph which compares line raggedness for print samples printed with a given ink set on Surface Treated Media (prepared as described in Example 1) and Commercial Offset Printing Paper.

Comparison of Line Raggedness Between Surface Treated Media and Commercial Offset Printing Media Line raggedness is the average of the leading edge and trailing edge raggedness and measures the appearance of geometric distortion of an edge from its ideal position. In this evaluation, media samples were imaged with the HP CM8060 Color MFP with Edgeline Technology (using the standard ink cartridges, herein labeled as Ink Set 2), which is manufactured by Hewlett-Packard Co. The samples were then allowed to air dry. The edge acuity of the black-to-yellow bleed was measured with a QEA Personal Image Analysis System (Quality Engineering Associates, Burlington, Mass.). Smaller values are indicative of better edge quality of the printed image. In the bar graph shown in FIG. 4, the y axis gauges increasing amounts of line raggedness as measured in microns. Two samples were printed with Ink Set 2, one on Commercial Offset Printing Paper and one on Surface Treated Media (prepared according to Example 1). The Surface Treated Media sample clearly shows less line raggedness.

Example 5

Comparison of Ink Absorption Between Surface Treated Media and Commercial Offset Print Media The Bristow wheel (also called the Paprican Dynamic Sorption Tester, model LBA92, manufactured by Op Test Equipment Inc.) was used to determine the differences in ink absorption between surface treated media and commercial offset printing media. Three different colors of ink were tested. The cyan and magenta inks are the same ones found in the HP CM8060 Color MFP with Edgeline Technology (labeled as ink set 2), which is manufactured by Hewlett-Packard Co. The black ink is the same one found in the HP PhotoSmart 8250 (labeled as ink set 3), which is manufactured by Hewlett-Packard Co. The test is designed to measure the amount of ink fluid absorbed onto the surface of the paper specimen under specific conditions and calculated using the following formula:

$$\text{Ink absorption rate}=\text{ink volume}/(\text{trace length}\times\text{trace width}\times\text{contact time})$$

Ideally, the ink absorption rate should fall somewhere in between the uncoated and coated commercial offset printing paper in order to dry quickly but still have good image quality.

Figure 5:
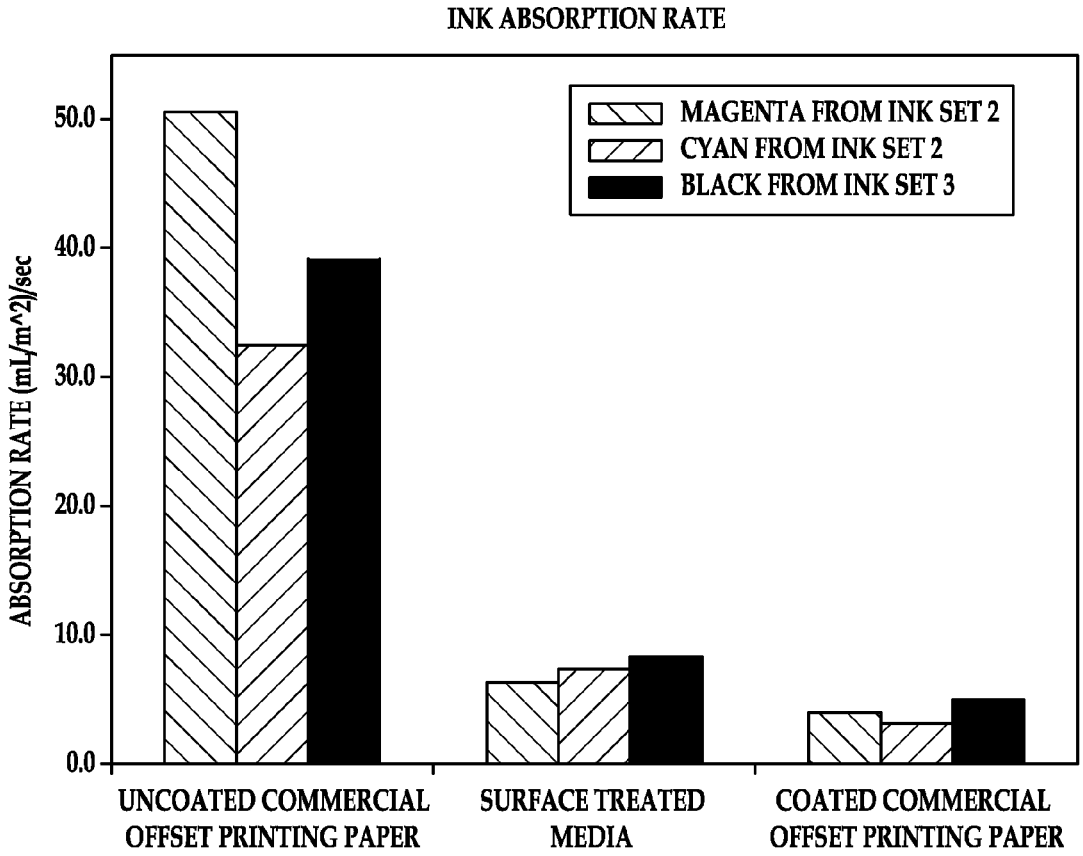
FIG. 5 shows a bar graph which compares ink absorption for print samples printed with three separate colors from given ink sets on Surface Treated Media (prepared as described in Example 1), Coated Commercial Offset Printing Paper, and Uncoated Commercial Offset Printing Paper.

In FIG. 5, a bar graph is shown, the y axis gauging increasing absorption rate ($mL/m^2/sec$). Three different colors of ink, magenta, cyan and black, from two different ink sets, ink set 2 and ink set 3, are printed on uncoated commercial offset print paper, surface treated media (prepared as in example 1) and coated commercial offset printing paper, respectively. FIG. 5 shows that surface treated media does fall between the other two samples in terms of absorption rate.

While several embodiments have been described in detail, it will be apparent to those skilled in the art that the disclosed embodiments may be modified. Therefore, the foregoing description is to be considered exemplary rather than limiting.

What is claimed is:

1. A print media for inkjet web-press printing, comprising:
a paper base; and
a porous surface treatment layer established on at least one surface of the paper base, the porous surface treatment layer including:
particles of at least one inorganic pigment selected from the group consisting of aluminum silicate, kaolin clay, calcium carbonates, mica, magnesium carbonates, alumina, boehmite, talc, and combinations thereof;
a co-pigment selected from calcium carbonate intercalcined with inorganic particles selected from titanium dioxide, silicon dioxide, aluminum trihydroxide, and zirconium oxide;
at least one polymeric carrier selected from the group consisting of water-soluble carriers, water-dispersible carriers, and combinations thereof; and
a fixer selected from the group consisting of fixers configured to fix a pigment-based inkjet ink to the print media, fixers configured to fix a dye-based inkjet ink to the print media, and combinations thereof;
wherein the fixer is a metal salt.

2. The print media as defined in claim 1, wherein about 5 wt % or less of the particles of the at least one inorganic pigment particles have a median equivalent spherical diameter of at least 4.5 microns; and about 10 wt % or less of the particles of the at least one inorganic pigment have a median equivalent spherical diameter of less than 0.3 microns.

3. The print media as defined in claim 1, wherein the metal cations of the salt is selected from the group consisting of Group I metals, Group II metals, Group III metals, transition metals, and combinations thereof.

4. The print media as defined in claim 3 wherein the anions of metal salts are selected from the group consisting of chlorides, iodides, bromides, nitrates, sulfates, sulfites, phosphates, chlorates, acetates, carboxylates and combinations thereof.

5. The print media as defined in claim 1 wherein the weight of the paper base ranges from about 35 gsm to about 90 gsm, and wherein the paper base further includes a filler present in an amount ranging from about 5 wt % to about 35 wt %.

6. The print media as defined in claim 1 wherein retention time of the paper base, measured by a Hercules size tester, ranges from about 10 seconds to about 95 seconds.

7. The print media as defined in claim 1 wherein the surface smoothness of the paper base, measured by a Parker Print-Surf tester, ranges from about 0.8 microns to about 6.0 microns.

8. The print media as defined in claim 1 wherein the coat-weight of the porous surface treatment layer ranges from about 2 gsm to about 10 gsm.

9. The print media as defined in claim 1 wherein the at least one inorganic pigment includes a platelet morphology, whereby the inorganic pigment substantially controls the amount of ink migration into the paper base, the rate of ink migration into the paper base, or combinations thereof.

10. The print media as defined in claim 1 wherein the at least one inorganic pigment is aluminum silicate and individual particles of the aluminum silicate have an equivalent spherical diameter of from about 0.9 micron to about 1.6 microns.

11. The print media as defined in claim 1 wherein the aspect ratio of the inorganic pigment particles ranges from about 10 to about 50.

12. The print media as defined in claim 1 wherein the porous surface treatment layer further includes an other fixer to fix a dye-based inkjet ink, the other fixer being a cationic polymer selected from the group consisting of polymers having a primary amino group, polymers having a secondary amino group, polymers having a tertiary amino group, polymers having a quaternary ammonium salt group, polymers having a phosphonium salt group, and combinations thereof.

13. A method of using a print media as defined in claim 1, comprising:

printing an image on the at least one surface of the paper base having the porous surface treatment layer thereon with a high speed digital inkjet web printing press.

14. The method as defined in claim 13, wherein about 5 wt % or less of the particles of the at least one inorganic pigment have a median equivalent spherical diameter of at least 4.5 microns; and about 10 wt % or less of the particles of the at least one inorganic pigment have a median equivalent spherical diameter of less than 0.3 microns.

15. The method as defined in claim 13, wherein a cation of the metal salt is selected from Group I metals, Group II metals, Group III metals, transition metals, and combinations thereof.

16. The print media as defined in claim 1 wherein the coatweight of the porous surface treatment layer is about 2 gsm.

17. A method of making a print media for inkjet web-press printing, comprising:

mixing particles of at least one inorganic pigment with at least one polymeric carrier, a co-pigment, and a fixer to form a porous surface treatment mixture;

subjecting the porous surface treatment mixture to a high shear mixing process to thereby substantially remove agglomerated particles present in the mixture;

applying the porous surface treatment mixture to at least one surface of a paper base; and drying the applied porous surface treatment mixture to form a porous surface treatment layer;

wherein the at least one inorganic pigment is selected from the group consisting of aluminum silicate, kaolin clay, calcium carbonates, mica, magnesium carbonates, alumina, boehmite, talc, and combinations thereof;

wherein the fixer is selected from the group consisting of fixers configured to fix a pigment-based inkjet ink to the print media; fixers configured to fix a dye-based inkjet ink to the print media and combinations thereof;

wherein the co-pigment is selected from calcium carbonate inter-calcined with inorganic particles selected from titanium dioxide, silicon dioxide, aluminum trihydroxide, and zirconium oxide;

wherein the at least one polymeric carrier is selected from the group consisting of water-soluble carriers, water-dispersible carriers, and combinations thereof;

and wherein the fixer is a metal salt.

18. The method as defined in claim 17, wherein about 5 wt % or less of the particles of the at least one inorganic pigment have a median equivalent spherical diameter of at least 4.5 microns; and about 10 wt % or less of the particles of the at least one inorganic pigment have a median equivalent spherical diameter of less than 0.3 microns.

19. The method as defined in claim 17, wherein a cation of the metal salt is selected from Group I metals, Group II metals, Group III metals, transition metals, and combinations thereof.

20. The method as defined in claim 17 wherein the mixing step comprises:

pre-dispersing the at least one inorganic pigment and the co-pigment in a filter-cake slurry;

then mixing the at least one polymeric carrier with the slurry, the at least one polymeric carrier comprising a non-ionic water soluble polymer solution; and then mixing the metal salt into the slurry.

21. The method as defined in claim 20, further comprising mixing a cationic polymer into the slurry.

22. The method as defined in claim 17 wherein applying the porous surface treatment mixture to at least one surface of a paper base is accomplished using a surface size press process.

23. The method as defined in claim 17, wherein applying the porous surface treatment mixture to at least one surface of a paper base is accomplished using at least one off-line technique selected from the group consisting of slot die coaters, roller coaters, fountain curtain coaters, blade coaters, rod coaters, air knife coaters, gravure applications, and air brush applications.

24. The method as defined in claim 17, further comprising applying a calendering process to the porous surface treatment layer.

* * * * *

UNITED STATES PATENT AND TRADEMARK OFFICE

CERTIFICATE OF CORRECTION

PATENT NO. : 8,053,044 B2
APPLICATION NO. : 11/831540
DATED : November 8, 2011
INVENTOR(S) : Xiaoqi Zhou, Kelly Ronk and Hai Quang Tran It is certified that error appears in the above-identified patent and that said Letters Patent is hereby corrected as shown below:

Title Page

Under the "Notice" section on the face of the issued patent, delete "This patent is subject to a terminal disclaimer."

Signed and Sealed this
Thirtieth Day of July, 2013

Teresa Stanek Rea
*Acting Director of the United States Patent and Trademark Office*